US006574923B1

(12) United States Patent
Johnsson et al.

(10) Patent No.: US 6,574,923 B1
(45) Date of Patent: Jun. 10, 2003

(54) ARRANGEMENT FOR A GRANDSTAND

(75) Inventors: Pär J Johnsson, Västerås (SE); Lars I Johnsson, Västerås (SE); Bo Johnsson, Västerås (SE)

(73) Assignee: Sit Down Aktiebolag, Vasteras (SE)

( * ) Notice: Subject to any disclaimer, the term of this patent is extended or adjusted under 35 U.S.C. 154(b) by 0 days.

(21) Appl. No.: 09/807,738

(22) PCT Filed: Oct. 6, 1999

(86) PCT No.: PCT/SE99/01775

§ 371 (c)(1),
(2), (4) Date: Apr. 18, 2001

(87) PCT Pub. No.: WO00/26486

PCT Pub. Date: May 11, 2000

(30) Foreign Application Priority Data

Nov. 2, 1998 (SE) ..... 9803733

(51) Int. Cl.[7] ..... E04H 3/12

(52) U.S. Cl. ..... 52/8; 52/6; 52/182; 52/191; 297/243

(58) Field of Search ..... 52/6, 7, 8, 9, 182, 52/191; 297/243; 248/74.2, 178.1, 218.4; 256/60, 65.01; 403/386, 397

(56) References Cited

U.S. PATENT DOCUMENTS 4,345,406 A 8/1982 Motley
4,747,238 A * 5/1988 Wikstrom et al. ..... 52/8

FOREIGN PATENT DOCUMENTS

DE 1 805 755 5/1970
SE 7800466-0 7/1982
SE 448 014 1/1987

* cited by examiner

*Primary Examiner*—Carl D. Friedman
*Assistant Examiner*—Jennifer I. Thissell
(74) *Attorney, Agent, or Firm*—Nixon & Vanderhye

(57) ABSTRACT

An arrangement for a grandstand having a series of sections, each section having a pair of sloping joists each provided with a number of vertical seating beam pillars and a number of walkways between the joists. Fastening and securing devices are provided at an upper part of each seating beam pillar. The fastening devices are provided with first locking devices capable of receiving second locking devices provided at the ends of seating beams intended to be mounted between two opposite seating beam pillars on the joists. One of the locking means has a resilient element. The first locking device is provided with a female member and the second locking device is provided with a male member. The resilient element allows connection of the male and female members with one another to lock the members in their connected positions. The resilient element has at least one tongue provided in connection with one of the members. The second member is provided with an abutment, and the tongue springs aside as the members are attached to each other and springs back into a position of attachment and contacts the abutment. The locking device allowing the seating beams to be attached to but not removed from the seating beam pillars without the use of tools.

5 Claims, 9 Drawing Sheets

30
20
36
38
34
32
42
40

ARRANGEMENT FOR A GRANDSTAND

TECHNICAL FIELD

The present invention relates to an arrangement for a grandstand, each section of which comprises a pair of sloping joists, each of said joists being provided with a number of vertical seating beam pillars, and a number of walkways provided between the joists.

BACKGROUND OF THE INVENTION

Various types of stationary and portable grandstand systems have been developed for different events, such as sport competitions, concerts, circuses, theatres, and the like. In the Swedish patent specification SE 448 014 an example of mobile grandstand systems is disclosed. The grandstand system disclosed in the patent specification consists of a number of profiles designed so that it will be possible to connect them to each other at a minimal use of screws, wedges, and similar fastening devices, but nevertheless providing a good stability.

For many events the demands on the grandstands have been raised—and that applies to the whole environment of the audience—because of those instances of violence on grandstands that have occurred during recent years, when "hooligans" have used details from the grandstands to cause each other injuries. From that point of view, the above mentioned grandstand system is not optimal, as some components can be pulled loose if some power is applied. It should, however, be mentioned that violence on grandstands and similar was not a serious problem when the above mentioned system was developed.

DISCLOSURE OF THE INVENTION

It is the purpose of the present invention to provide a grandstand system which is possible to mount smoothly and easily without a lot of loose details, and which cannot be dismounted without great difficulties or without tools.

This is achieved according to an aspect of the invention by means of an arrangement according to the preamble, characterised in that the arrangement comprises fastening and securing devices provided at the upper part of each seating beam pillar, said fastening devices being provided with first locking means capable of receiving second locking means at the end of seating beams intended to be mounted between two opposite seating beam pillars on the joists, said locking means allowing the mounting but not removal of the seating beams from the seating beam pillars without the use of tools.

According to another aspect of the invention, the invention is characterised in that one of the locking means comprises a resilient element, that the first locking means is provided with a female member and the second locking means with a male member, that the resilient element is designed as at least one tongue provided in connection with one of said members, that the second member is provided with an abutting means, designed such that the tongue will spring aside as the members are attached to each other and will spring back in the position of attachment and contact the abutting means.

According to another aspect of the invention, the invention is characterised in that each seating beam pillar comprises two vertical, elongated spaces, provided after one another in the direction of the joists, when viewed from above, for the mounting of rail sections, each rail section comprising two outer, vertical pillars, which are connected with each other through transversal connecting members and adapted to said vertical spaces, the distance between the vertical pillars of the rail section corresponding to the distance between the opposite spaces of two adjacent seating beam pillars, and that the fastening device comprises locking members capable of locking one of said vertical pillars when both the vertical spaces in a seating beam pillar accommodate vertical pillars.

According to still another aspect of the invention, the invention is characterised in that the resilient element comprises a projection on a flexible arm, that the locking means comprises a recess on the first vertical pillar, and that the projection is urged into the recess, when the second vertical pillar is provided in the second vertical space.

The arrangement of the invention has several advantages. Through the provision of the upper portion of the seating beam pillar and the ends of the seating beam with locking means, which allow the mounting and interlocking without the use of tools, but which require tools for dismounting, a quick and neat way of mounting the grandstand system is made possible, at the same time as the arrangement secures that the seating beams cannot be dismounted by the spectatators and be used as for example weapons.

Due to the fact that the locking means comprise a resilient element or tongue, which can spring aside in connection with the mounting operation and is adapted to rest against an abutment, there is achieved a safe and functional locking without complicated mechanical constructions.

Also the locking of the rail sections is safe and functional, since the function of the locking cause the sections successively to be locked to each other and also because resilient elements are utilised.

These and other aspects and advantages of the present invention will apparent from the detailed description of a preferred embodiment and from the appending patent claims.

BRIEF DESCRIPTION OF DRAWINGS

In the following description of a preferred embodiment, reference will be made to the accompanying drawings, in which.

DESCRIPTION OF PREFERRED EMBODIMENT

As far as the general construction of the mobile grandstand system is concerned, reference is made to the Swedish patent specification SE 448 014, which hereinafter is incorporated by reference.

Figure 1:
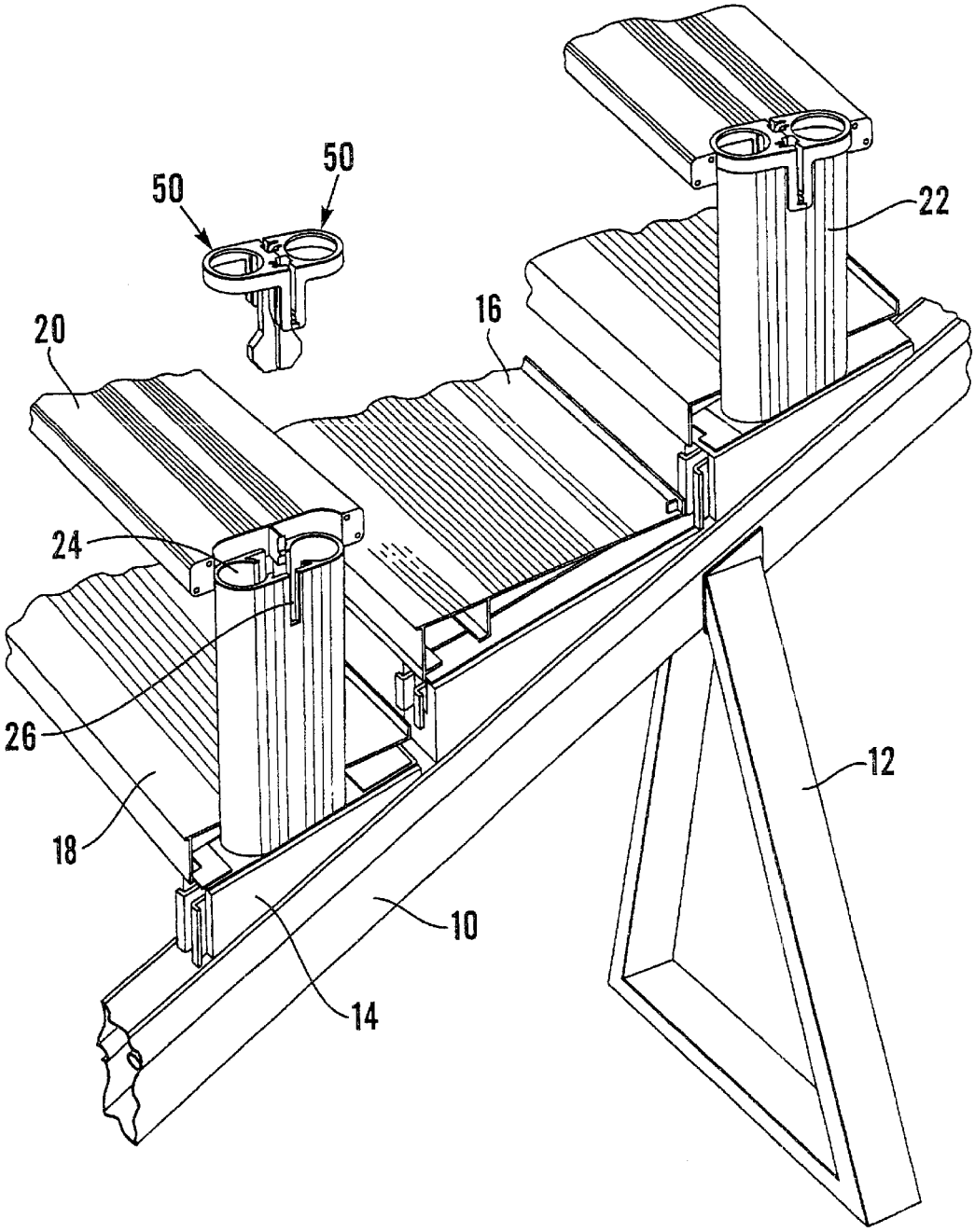
FIG. 1 shows a part of the grandstand system according to the invention.
Figures 2, 3:
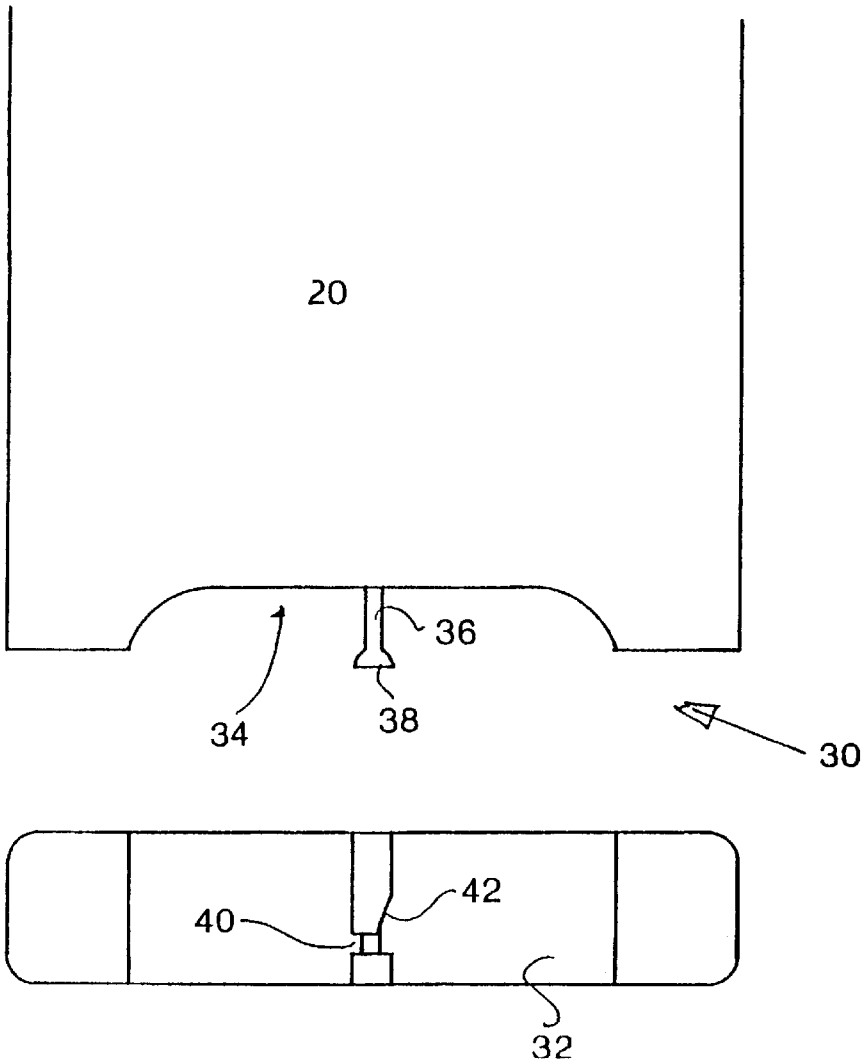
FIG. 2 shows an end surface of a seating beam included in the invention according to FIG. 1.
FIG. 3 shows a part of the seating beam in FIG. 2, turned 90°.

With reference to FIG. 1, the grandstand system consists of sections, where each section comprises two sloping joists 10, one such joists being shown in FIG. 1. Each joist is carried by a number of threstles 12 or the like of different height. On the upper surfaces of the joists, wedge-shaped profile pieces 14 are provided. A number of profile beams extend between the joists. The beams comprise walkways 16, coverboards 18, and seating beams 20. If desired, seats may be mounted on the seating beams. Seating beam pillars 22 are mounted on the upper side of every second wedge-shaped profile piece along the extension of the joist. The seating beam pillar has two circular cylindrical vertical spaces 24. Further, two slots 26 are provided at the upper end of the seating beam pillar, one such slot on each side of the seating beam pillar between the said circular cylindrical spaces, and also a central slot between the circular cylindrical, vertical spaces. Fastening and securing devices 30 are provided in each end of the seating beam, FIG. 2. These devices comprise an end pate 32 connected to the end of the seating beam. The end plate is designed with a recess 34 with rounded edges to provide a profile which, when viewed from above, comprises approximately half the profile of the seating beam pillar as viewed from above. A connecting stud 36 is provided in the recess perpendicular to the surface of the recess. The connecting stud as viewed from above is designed as an erected plate, the outer of which is terminated by a thicker portion 38. In a side elevation towards the end of the seating beam, it is seen that the plate is provided with a horizontal slot 40, which extends inwards towards the recess. One edge of the upper part above the slot is provided with a bevel 42.

Figure 4:
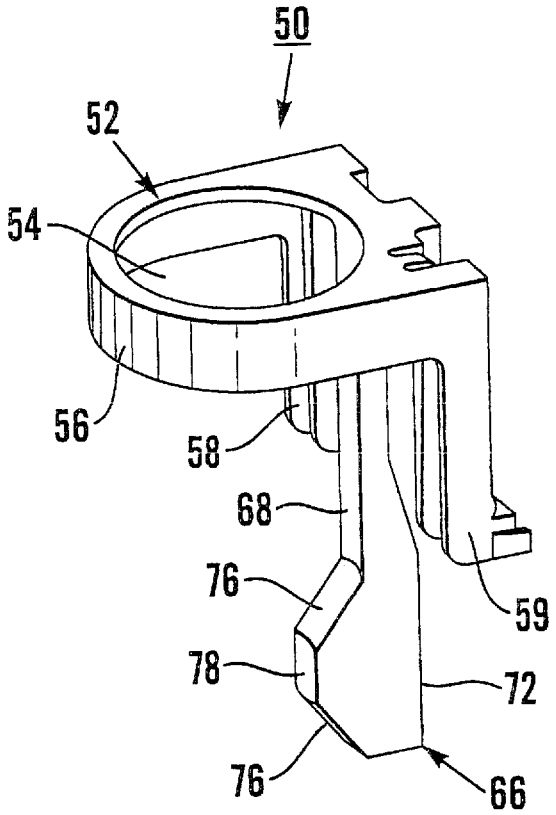
FIG. 4 shows a view obliquely from above of a securing device included in the invention.
Figure 5:
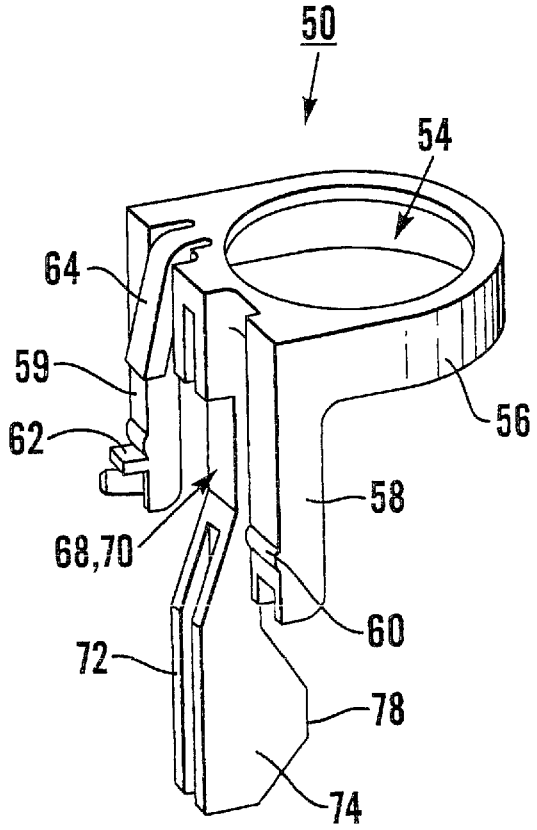
FIG. 5 shows a view of the securing device according to FIG. 4, turned 180°.
Figure 6:
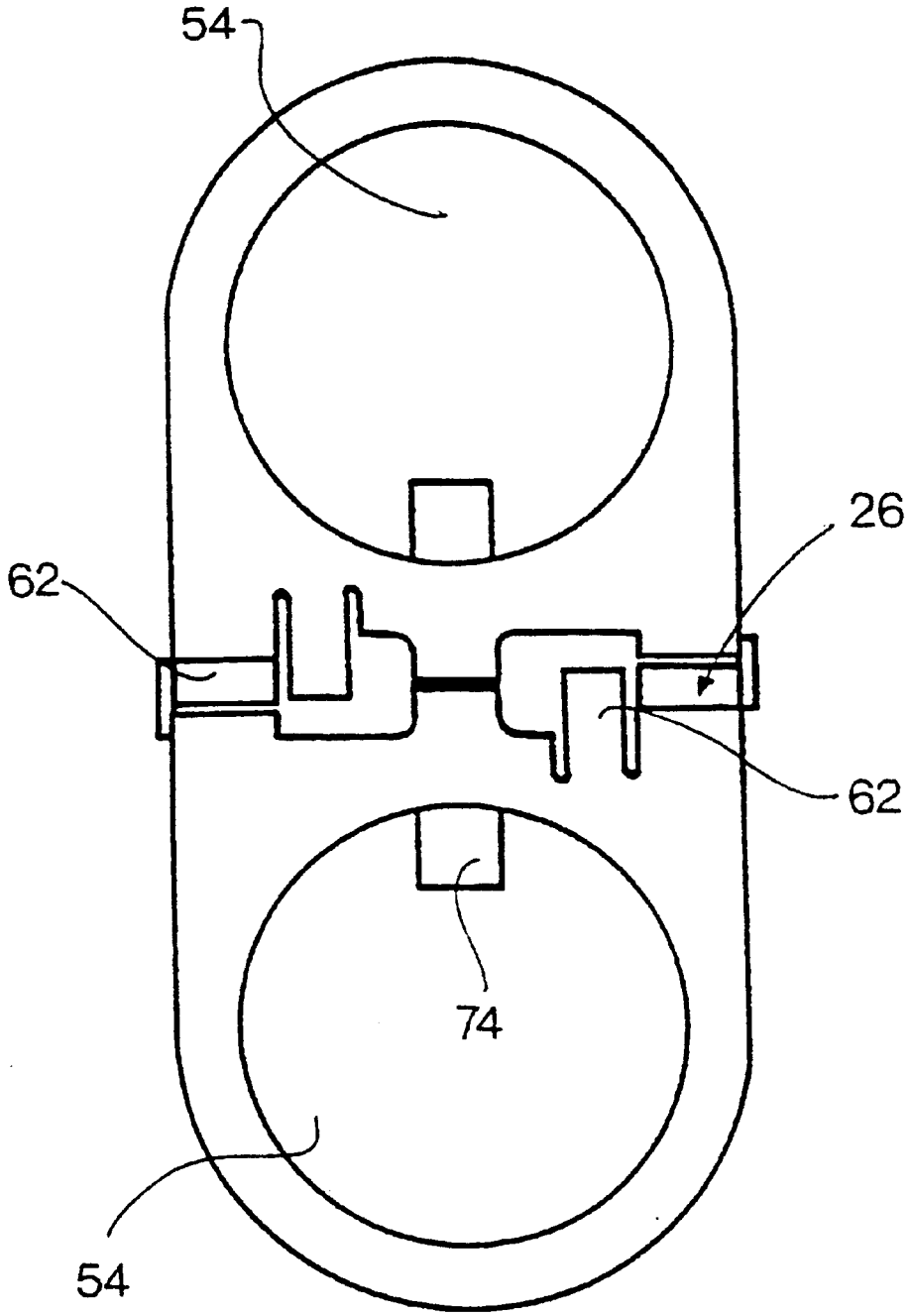
FIG. 6 shows a view from above of a seating beam pillar provided with two securing devices.

The upper portions of each seating beam pillar are provided with two identically designed securing devices 50, FIGS. 4–6. The securing devices comprise an upper portion 52 with a cylindrical opening 54 with a diameter corresponding to the openings of the seating beam pillars. The upper portion has a collar or rim 56, which extends downwards and has a design which is adapted to the outer profile of the seating beam. The securing devices further comprise two legs 58, 59 extending further downwards and having the shape of U-profiles which open rearwards. A first leg 58 is provided with a projection or bulge 60 in its lower part. The second leg 59 has a nose or dog 62 in its lower part, approximately perpendicular to the longitudinal direction of the leg. Further, a tongue 64 is provided, extending obliquely downwards from the upper edge of the rim portion between said legs. A locking means 66 is provided at the centre of the rear edge of said upper portion. The locking means comprises a downwardly projecting arm 68, which is rectangular in cross section. On the arm, at a distance from the top, a recess 70 is provided, a first edge thereof being perpendicular to the longitudinal direction of the arm, while the second edge is bevelled, whereafter follows a flat portion 72. On the opposite side of the arm, in the lower part thereof, a projection 74 is provided, said projection having bevelled upper and lower surfaces 76 and a straight middle section 78. The downwardly directed tongue 64 as well as the arm 68 is somewhat resilient. When the securing devices are positioned in the seating beam, the flat portions 72 on the arms of the devices will abut each other, whereas the legs 58, 59 and the dog 62 will fit in the slot 26 in the seating beam pillar and form the edge surfaces of the slot.

Figure 8:
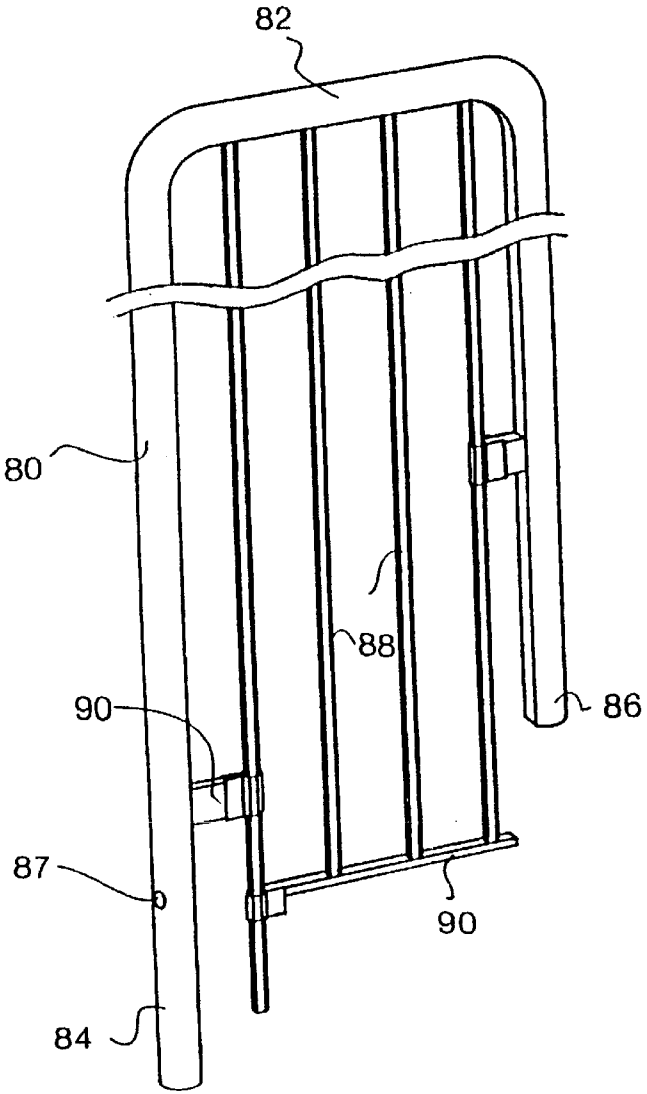
FIG. 8 shows a rail section included in the invention.
Figure 9:
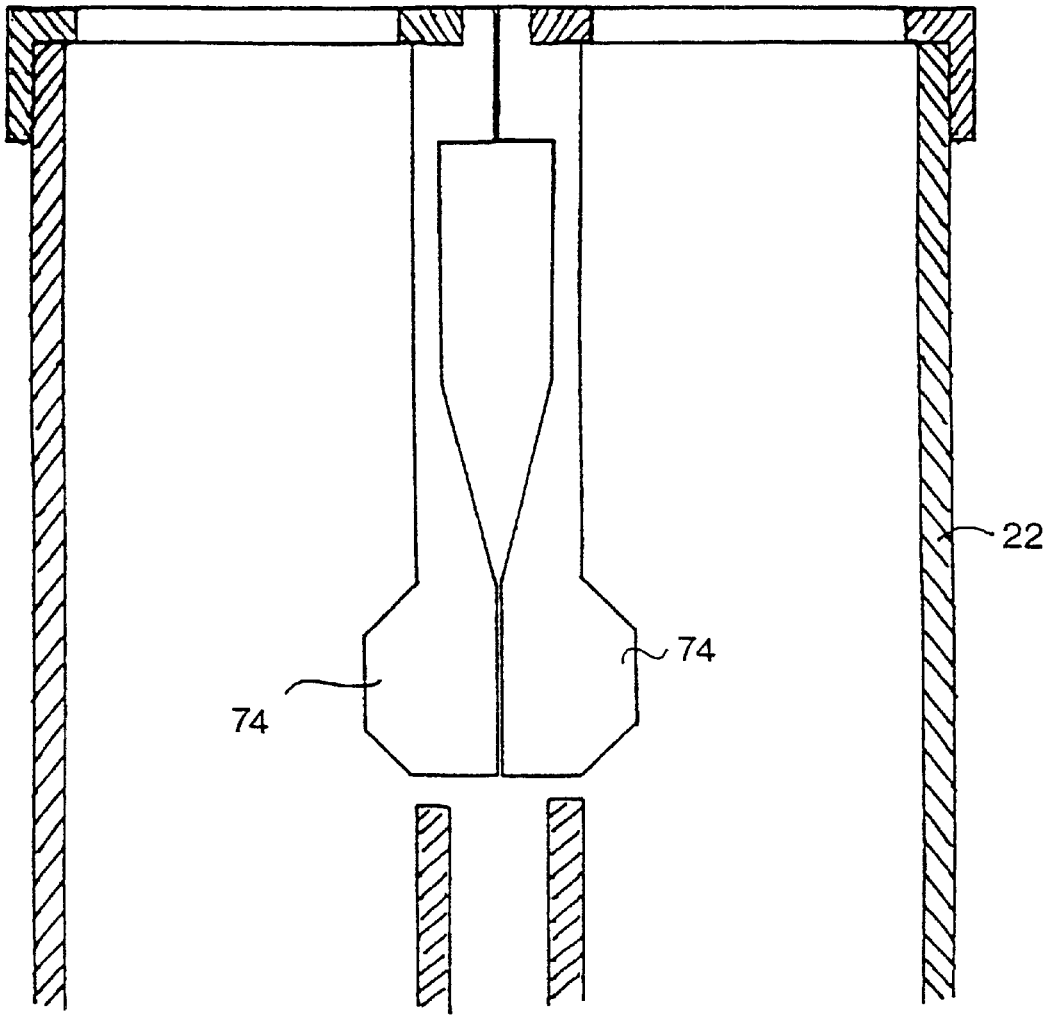
FIGS. 9–11 show how the securing device and the rail cooperate for securing the rail.

The system also includes rail sections, FIG. 8, which are designed in order to demarcate the different sections of the grandstand system and to prevent people from falling down from the grandstand. The rail sections include an outer pipe 80, which is bent to U-shape, the bottom section 82 of the U defining an upper rail portion having two vertical pipe sections 84, 86. A first one of the vertical pipe sections, pipe section 84, is longer than the second one. A bevelled hole 87 is located in the lower part of the longer, vertical pipe section 84. A number of vertical bars 88 are connected to the bottom side of the upper rail section 82 and to the vertical pipe sections and to each other through horizontal struttings 90. The distance between the vertical pipe sections corresponds to the distance between the two opposite spaces of two adjacent seating beam pillars, such that a rail section will close the opening between two seating beam pillars.

Figure 7:
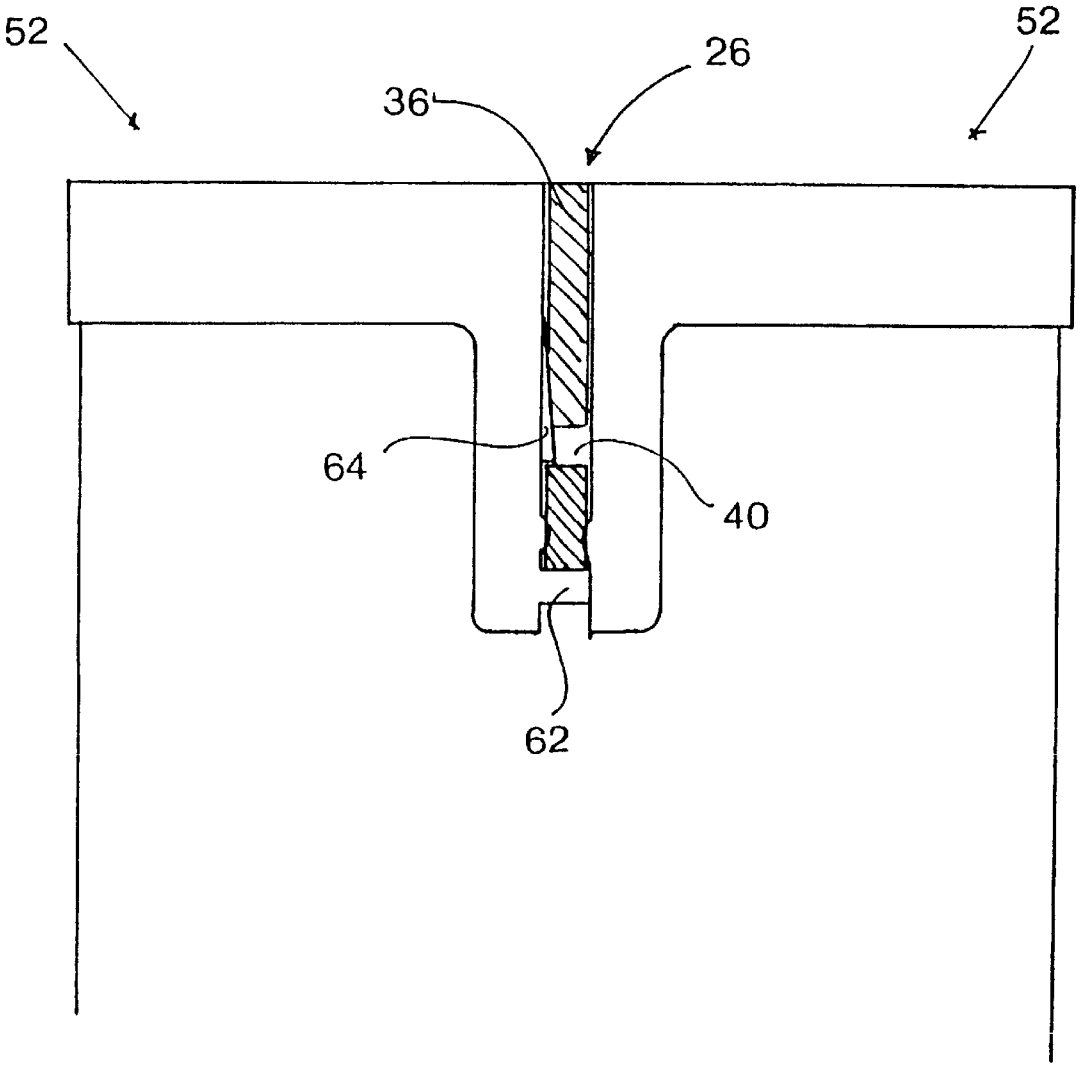
FIG. 7 shows a view of part of the seating beam pillar according to FIG. 6.

The system is conceived to function in the following way. The joists 10 are placed on the threstles 12 to provide a correct inclination, whereafter walkways 16 and coverboards 18 are placed between the joists and are secured to the joists in a suitable way. The connection stud 36 is pushed down in the slot 26 in the seating beam pillar, said connecting stud and slot functioning as a male member and a female member, respectively, wherein the tongue 64 of the securing device will spring aside until the bottom side of the connecting stud of the seating beam will abut the dog 62. In this position, the tongue 64 will end up in the bevel 42 and latch the seating beam, preventing it from being lifted therein, as the tip of the tongue due to its spring action and to the bevel will abut the horizontal bottom surface of the slot 40, FIG. 7. In order to dismount the seating beam from the seating beam pillar some type of tool is required, e.g. a thin metal disc which can be inserted into the slot at the side of the connection stud, such that the tongue can be pushed aside from the bevel, whereafter the seating beam can be lifted up.

Figure 10:
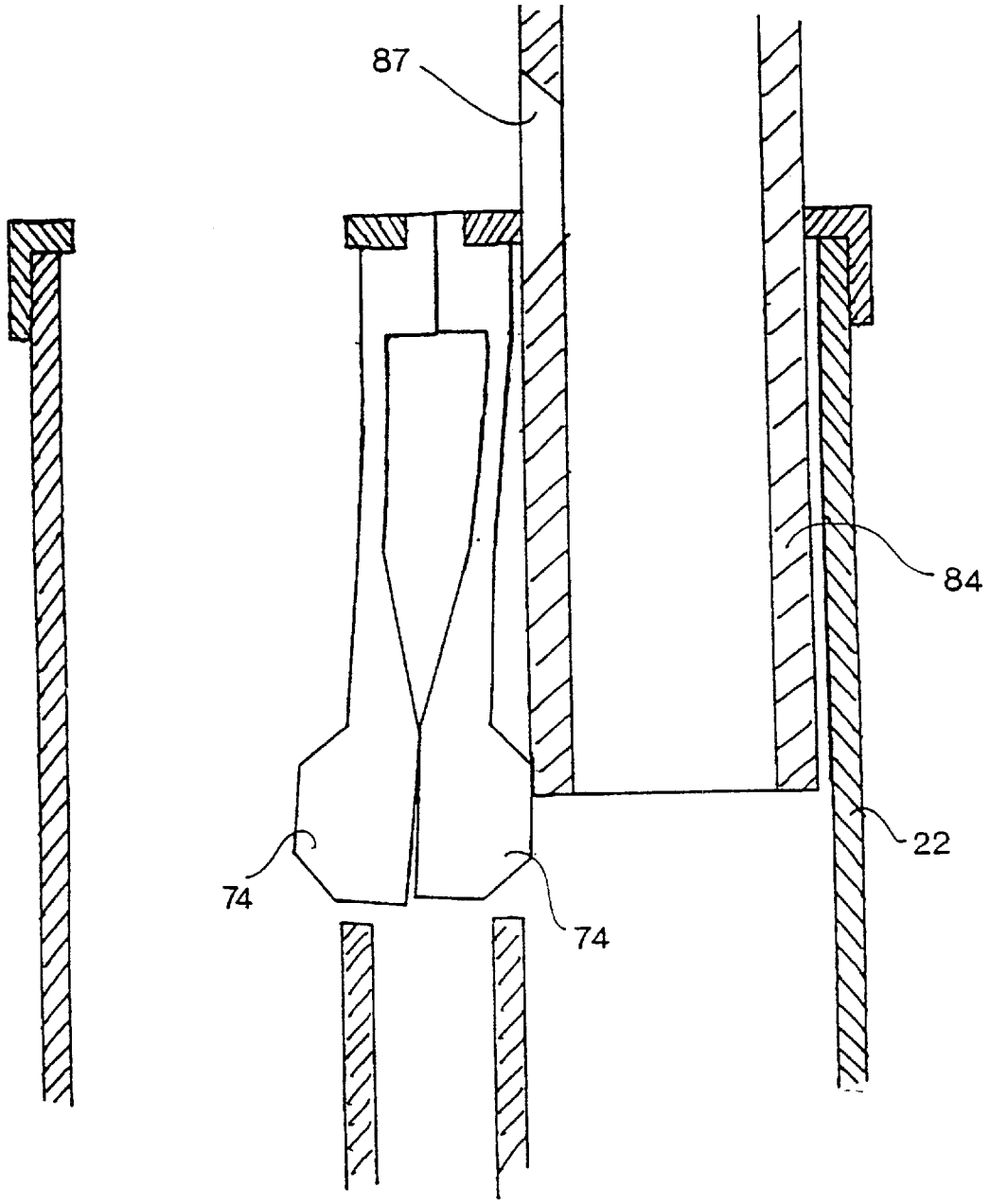
Figure 11:
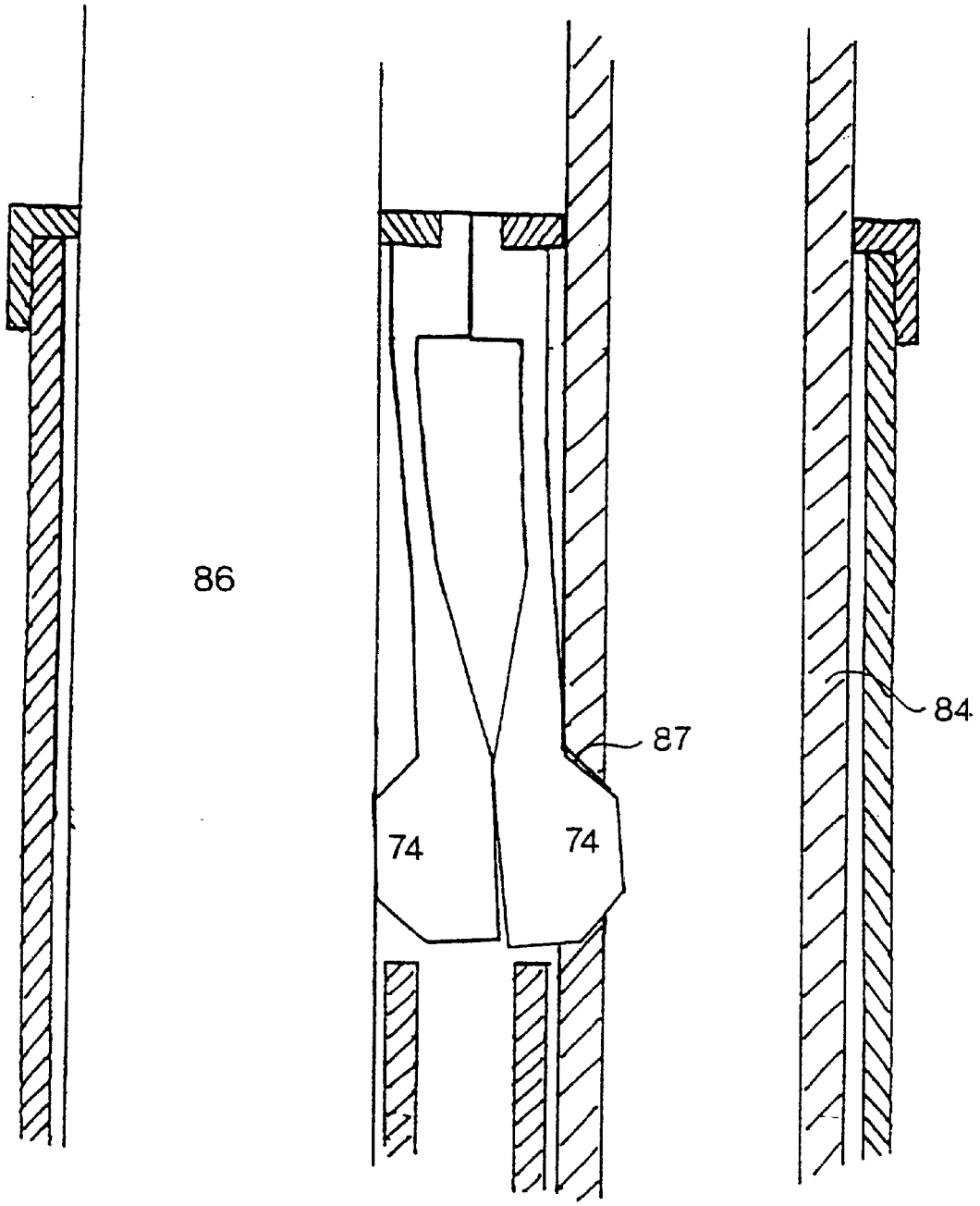

The mounting and locking of the rail sections are carried out therein that one starts by mounting at the top of the grandstand section by inserting the vertical pipe sections 84, 86 down into the opposite, vertical spaces 54 of two adjacent seating beam pillars 22. When the pipe sections have been moved down to the projections 74, the projections will spring aside towards the still empty, second vertical space in the seating beam pillar, FIG. 10, where there is not yet any pipe section accommodated. The rail section then is moved further downwards, until the vertical pipe section 84 with its bevelled hole 87 will be on level with the projections, wherein one of the projections will spring a little distance into the hole 87. Then the next rail section will be pushed down, a pipe section 86 being pushed down into the second vertical space in the seating beam pillar and a pipe section 84 into next seating beam pillar. The bevelled hole 87 is given such a size that the projection 74 can be pressed further into the hole as the second pipe section 86 contacts the projections, FIG. 11. The firstly mounted rail section now is secured therein, that the pipe section of the next rail section is pressing the projection into the bevelled hole, latching it in the vertical direction. Then, the mounting of rail sections proceeds, such that they successively will lock each other. The last rail section is secured therein that a single pipe is moved down into the last vertical space in the lowermost seating beam pillar. This pipe presses the projection into the bevelled hole of the last rail section, securing said last section. Dismounting is performed in the opposite way, wherein a tool is required to lift up said single pipe.

It shall be understood that the invention is not limited to the embodiment which is described above and shown in the drawings but can be modified within the scope of the appending patent claims.

What is claimed is:

1. An arrangement for a grandstand comprising sections, each section comprising:

a pair of sloping joists, each of said joists being provided with a number of vertical seating beam pillars, and a number of walkways provided between said joists;

fastening and securing devices provided at an upper part of each seating beam pillar, said fastening devices being provided with first locking means capable of receiving second locking means provided at ends of seating beams intended to be mounted between two opposite seating beam pillars on said joists, one of said locking means comprising a resilient element, said first locking means being provided with a female member, said second locking means being provided with a male member, said resilient element allowing connection of said male and female members with one another and locking said members in their connected positions, said resilient element comprising at least one tongue provided in connection with one of said members, said second member being provided with an abutting means, said tongue springing aside as said members are attached to each other and springing back into a position of attachment and contacting said abutting means, said locking means allowing said seating beams to be attached to but not removed from said seating beam pillars without the use of tools.

2. An arrangement according to claim 1, wherein said female member is a slot in said fastening device and in said seating beam pillar, said slot being open in the upper end thereof as viewed in a longitudinal direction of said seating beam pillar, said tongue being provided in connection with an upper edge of said slot and being directed downwards, said male member being a vertical plate connected to an end of said seating beam, said plate being provided with a horizontal slot having a bevel at its upper edge, wherein, when mounting, said plate is moved down in the slot in the fastening device, said tongue is caused to spring aside and, when said plate has been accommodated in the slot, the lower end of the tongue springs back and contacts the surface of the horizontal slot.

3. An arrangement according to claim 2, wherein each seating beam pillar comprises two vertical elongated spaces provided after one another in a direction of said joist, when viewed from above, for mounting of rail sections, each rail section comprising two outer vertical pillars which are connected with each other through transverse connecting members and adapted to said vertical spaces, the distance between the vertical pillars of the rail section corresponding to the distance between opposite spaces of two adjacent seating beam pillars, said fastening device comprising locking members capable of locking one of said vertical pillars when both the vertical spaces in a seating beam pillar accommodate vertical pillars.

4. An arrangement according to claim 3, wherein said locking member comprises a resilient element designed to spring aside when a first vertical pillar is accommodated in a vertical space in a seating beam pillar, said first vertical pillar being provided with locking means, wherein, when a second vertical pillar is accommodated in a second vertical space in said seating beam pillar, said resilient element fits with said locking means locking the position of the vertical pillar.

5. An arrangement according to claim 4, wherein said resilient element comprises a projection on a flexible arm, said locking element comprising a recess on a first vertical pillar, said projection being urged into said recess when a second vertical pillar is provided in said second vertical space.

* * * * *